US007121687B2

(12) United States Patent
Sidwell et al.

(10) Patent No.: US 7,121,687 B2
(45) Date of Patent: Oct. 17, 2006

(54) AUTOMOTIVE LED BULB

(75) Inventors: Steven Sidwell, Hopkinton, NH (US); Kim Albright, Warner, NH (US); Charles M. Coushaine, Rindge, NH (US); Brad Ernest, Hookset, NH (US)

(73) Assignee: Osram Sylvania Inc., Danvers, MA (US)

( * ) Notice: Subject to any disclaimer, the term of this patent is extended or adjusted under 35 U.S.C. 154(b) by 95 days.

(21) Appl. No.: 11/042,405

(22) Filed: Jan. 25, 2005

(65) Prior Publication Data

US 2006/0164835 A1 Jul. 27, 2006

(51) Int. Cl.
*F21V 21/00* (2006.01)

(52) U.S. Cl. ..... 362/249; 362/252; 362/294; 362/373; 362/121; 362/807

(58) Field of Classification Search ..... 362/249, 362/252, 294, 346, 800, 121, 807
See application file for complete search history.

(56) References Cited

U.S. PATENT DOCUMENTS 4,562,516 A * 12/1985 Chastain ..... 362/500
6,991,351 B1 * 1/2006 Petrick ..... 362/373
2003/0193802 A1 * 10/2003 Luk ..... 362/249
2004/0184272 A1 * 9/2004 Wright et al. ..... 362/373
2005/0174769 A1 * 8/2005 Yong et al. ..... 362/235
2006/0098438 A1 * 5/2006 Ouderkirk et al. ..... 362/294

* cited by examiner

*Primary Examiner*—Thomas M. Sember
(74) *Attorney, Agent, or Firm*—William E. Meyer

(57) ABSTRACT

An LED lamp having a support with a metal substrate and a center portion with projecting wings. An electrically insulating, thermally conductive circuit is affixed to the substrate; and at least one LED is positioned on each wing with electrically conductive traces connected thereto. The center portion is planar. The wings are bent at multiple angles forming legs, a first angle being greater than 90 degrees, a second angle being normal to the planar center portion. The preferred center portion is pentagonal. The bulb cooperates with a socket that comprises a base; a hollow pedestal extending from the base, the pedestal having a polygonal interior; a thermally conductive, core having an exterior matching the interior; a gap between interior walls of the interior and exterior walls; and a plurality of electrical contacts positioned in the gap for contacting the traces when the bulb is inserted in the socket.

7 Claims, 2 Drawing Sheets

AUTOMOTIVE LED BULB

TECHNICAL FIELD

This invention relates to lamps and more particularly to replaceable lamps. Still more particularly the invention relates to lamps for automotive use and more particularly still to lamps employing light emitting diodes (LED or LEDs).

BACKGROUND ART

LEDs have been in use for some time in automotive applications, particularly in the center high mount stop lights (CHMSL). The LEDs are rugged and have extremely long life. The LEDs in use for CHMSLs have been hard-wired into position and generally, are not easily replaceable. Recently, the use of LEDs for stoplights and taillights has increased but, again, a simple, replaceable unit with adequate light output has not been forthcoming. U.S. Published Patent Application No. 2003/0063476 A1, assigned to the assignee of the present invention, discloses a replaceable LED lamp capsule having LED chips arranged about the periphery of a shaft; however, heat dissipation can be a problem with such a construction. Part of the latter problem arises because, at the power requirements necessary to supply the requisite light output for automotive use, a substantial amount of heat is generated which must be removed or the lifetime of the LEDs is severely limited.

DISCLOSURE OF INVENTION

It is, therefore, an object of the invention to obviate the disadvantages of the prior art.

It is another object of the invention to enhance LED lights.

It is another object of the invention to provide a replaceable LED lamp unit.

Still another object of the invention is a replaceable LED lamp unit having long life and superior heat dissipation.

These objects are accomplished, in one aspect of the invention, by an LED bulb for a lamp, wherein the bulb comprises a support having a metal substrate with a center portion and a plurality of projecting wings; an electrically insulating, thermally conductive circuit board affixed to said substrate; and at least one light emitting diode positioned on each of said wings and having electrically conductive traces connected thereto.

The bulb is replaceably fitted to a socket that comprises a base; a hollow pedestal extending from said base, said hollow pedestal having a polygonal interior; a thermally conductive, polygonal core having an exterior matching said polygonal interior in configuration; a gap between interior walls of said polygonal interior and exterior walls of said polygonal core; and a plurality of electrical contacts positioned in said gap.

The intimate contact between the metallic substrate and the thermally conductive core assures good heat reduction from the operating lamp.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
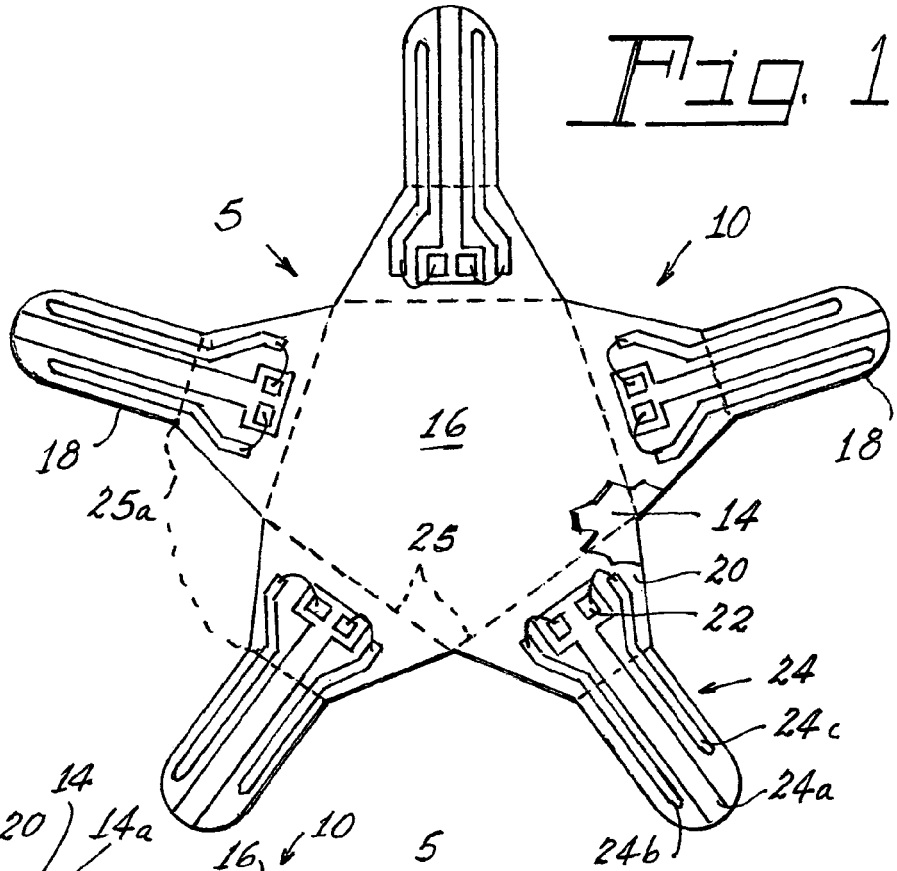
FIG. 1 is a plan view of an embodiment of a bulb according to an aspect of the invention.

Referring now to the drawings with greater particularity, there is shown in FIG. 1 a bulb 5 for a lamp 12. The bulb 5 comprises a support 10 having a metal substrate 14 with a center portion 16 and a plurality of projecting wings 18. An electrically insulating, thermally conductive circuit board 20 of like configuration is affixed to the substrate 14 and at least one light emitting diode 22 is positioned on each of the wings 18. Electrically conductive traces 24 are formed on a first side of the circuit board. A second side of the circuit board may be grooved along lines 25, 25*a* to enhance bending the wings 18. In the particular embodiment shown the center portion 16 is pentagonal; however, any polygon having N sides, where N is greater than 2 is contemplated by the invention. For practical purposes N should be from 2 to 12. As shown the wings 18 are provided with a common cathode conductive trace 24*a* which mounts two LEDs 22, and two anode traces 24*b* and 24*c* respectively. Other circuitry is permissible and will depend upon the light output desired or a particular sequence of operation for the LEDs.

Figure 3:
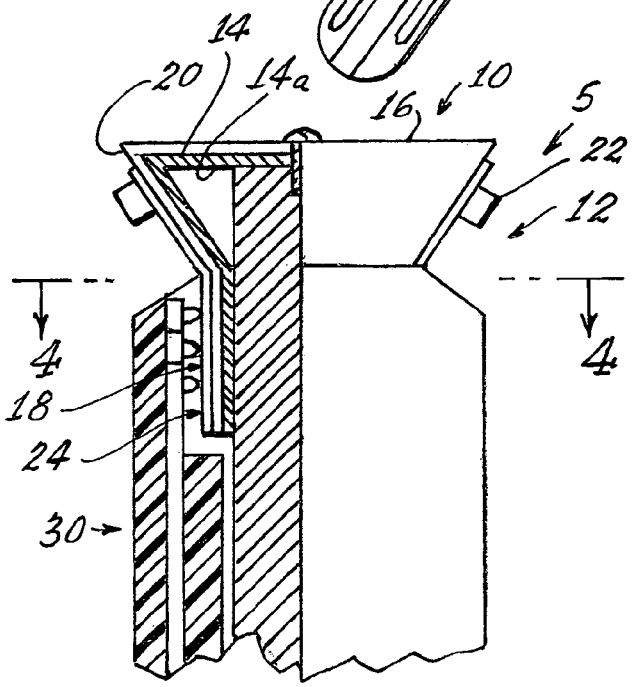
FIG. 3 is an elevational view, partially in section, of a socket for the bulb.
Figure 2:
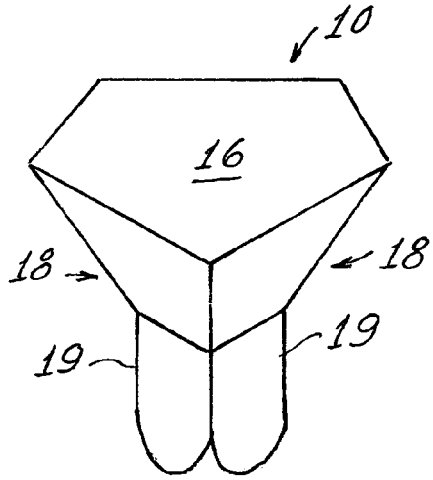
FIG. 2 is a perspective view of the bulb of FIG. 1 after it has been folded and with the LEDs omitted for clarity.

After the formation of the support 10 the wings 18 are bent at multiple angles to along the lines 25, 25*a* to form legs 19 as shown in FIGS. 2 and 3. A first of the angles is greater than 90 degrees and the second of the angles is normal to the planar center section 16, thus allowing the legs 19 to be inserted into a socket 30. The second bend (along line 25*a*) is in compression and thus not disruptive to the low-voltage traces, 24*a, b* and *c*.

Figure 4:
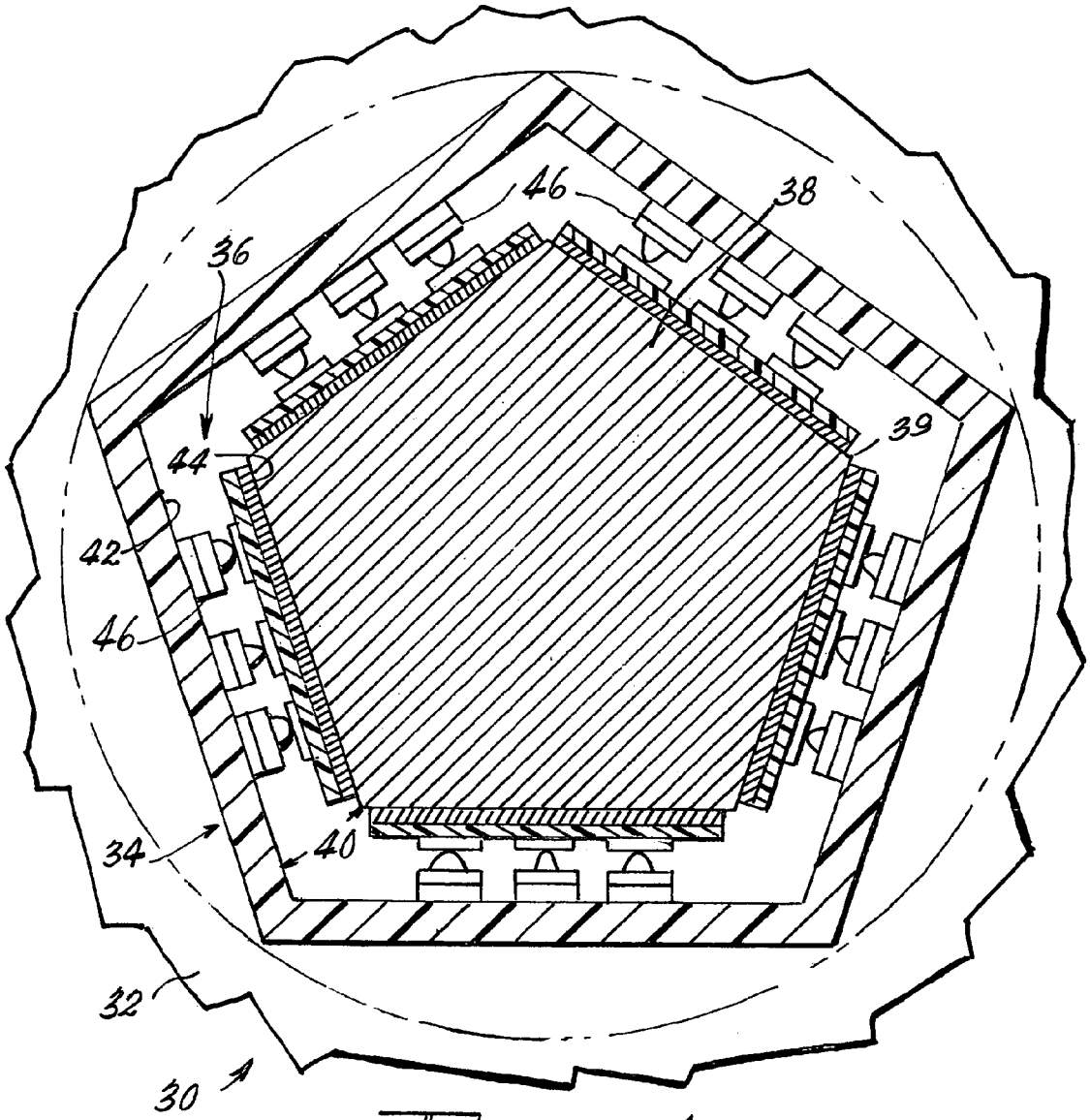
FIG. 4 is sectional view taken along the line 4—4 of FIG. 3.

The socket 30 is shown in FIGS. 3 and 4 and comprises a base 32 with a hollow pedestal 34 extending therefrom. The hollow pedestal 34 has at least a corresponding polygonal interior 36, which in the embodiment shown is pentagonal. A thermally conductive core 38 is positioned within the hollow pedestal and has an exterior surface 39 that matches the configuration of the interior 36. The core 38 extends beyond the upper surface of the pedestal 34.

A gap 40 exists between the interior walls 42 of the interior 36 and the exterior walls 44 of the core 38 and a plurality of electrical contacts 46 are fitted in the gap 40. These may be spring contacts and may be insert molded into pedestal 34.

The legs 19 of the bulb 5 are fitted into the gap 40 with the electrical contacts 46 engaging the traces 24*a*, 24*b* and 24*c*, as appropriate. Traces 24 can be of variable length to engage contacts 446 as desired for a variable circuit configuration.

The inner surface 14*a* of the metal substrate 14 is in intimate contact with the thermally conductive core 38 at its upper surface and along the exterior surface 39 where the legs 19 make intimate contact that is also aided by the tension applied by the electrical contacts 46.

Thus there is provided a replaceable bulb and socket for an LED light source that is reproducible and has excellent heat dissipation quality due intimate metal-to-metal contact.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A bulb for a lamp comprising:

a metal substrate having a center portion and a plurality of projecting wings;

wherein said center portion is planar and said wings are bent at angles to said center portion to form legs;

an electrically insulating, thermally conductive circuit board affixed to said substrate;

at least one light emitting diode positioned on at least one of said wings and having electrically conductive traces connected thereto;

said electrically conductive traces including exposed portions for electrical contact thereto extending on at least one wing, said at least one wing being sized and shaped for mechanical insertion into an electrical socket, and said exposed trace portions thereon being aligned for mechanical and electrical contact in said electrical socket.

2. The bulb of claim 1 wherein said center portion is planar and said wings are bent at multiple angles, a first of said angles being greater than 90 degrees and the second of said angles being normal to said planar center portion.

3. The bulb of claim 1 wherein said center portion is polygonal.

4. The bulb of claim 1 wherein at least one light emitting diode is positioned on each of said wings and having electrically conductive traces connected thereto.

5. The bulb of claim 1 wherein the legs form plug connectors for a socket.

6. The bulb of claim 1 wherein the leg portions form plug connetectors for a socket.

7. A replaceable lamp bulb and socket for such a replaceable lamp bulb combination comprising:

a metal substrate having a center portion and a plurality of projecting wings;

wherein said center portion is planar and said wings are bent at angles to said center portion to form legs;

an electrically insulating, thermally conductive circuit board affixed to said substrate;

at least one light emitting diode positioned on at least one of said wings and having electrically conductive traces connected thereto; and said electrically conductive traces including exposed portions for electrical contact there to extending on at least one wing, said at least one wing being sized and shaped for mechanical insertion into an electrical socket, and said exposed trace portions thereon being aligned for mechanical and electrical contact in said electrical socket; and wherein said electrical socket for comprises:

a base;

a hollow pedestal extending from said base, said hollow pedestal having a polygonal interior;

a thermally conductive, polygonal core having an exterior matching said polygonal interior in configuration;

a gap between interior walls of said polygonal interior and exterior walls of said polygonal core; and a plurality of electrical contacts positioned in said gap.

* * * * *